US005501158A

United States Patent [19]

Cheney

[11] Patent Number: 5,501,158

[45] Date of Patent: Mar. 26, 1996

[54] PORTABLE WORK BENCH

[76] Inventor: Kirk S. Cheney, 236 Havelock Street, Toronto, Ontario, Canada, M6H 3B9

[21] Appl. No.: 322,158

[22] Filed: Oct. 13, 1994

[30] Foreign Application Priority Data

Oct. 14, 1993 [CA] Canada ..... 2108414

[51] Int. Cl.[6] ..... A47B 3/00

[52] U.S. Cl. ..... 108/165; 108/167; 108/115

[58] Field of Search ..... 108/165, 162, 108/166, 169, 171, 115; 211/135, 149; 182/152

[56] References Cited

U.S. PATENT DOCUMENTS

| | | | |
|---|---|---|---|
| D. 213,400 | 2/1969 | Cannon . | |
| 493,479 | 3/1893 | Carl . | |
| 1,625,294 | 3/1927 | Whitesides . | |
| 1,943,871 | 1/1934 | Lamberg . | |
| 2,132,785 | 10/1938 | Hill | 108/165 |
| 3,726,412 | 4/1973 | Resnicoff | 211/135 |
| 4,113,056 | 9/1978 | Delorenzo . | |
| 4,124,093 | 11/1978 | Breisch . | |
| 4,296,834 | 10/1981 | Kroger . | |
| 4,319,663 | 3/1982 | Barden . | |
| 4,403,678 | 9/1983 | Zieg . | |
| 4,437,413 | 3/1984 | O'Brien . | |
| 4,534,447 | 8/1985 | Champigny . | |
| 4,618,115 | 10/1986 | Belokin, Jr. | 211/135 X |
| 4,638,885 | 1/1987 | Frederick . | |
| 4,763,759 | 8/1988 | Cheney . | |
| 4,854,246 | 8/1989 | Belokin et al. | 108/162 |
| 5,315,946 | 5/1994 | Smith | 108/165 |
| 5,335,593 | 8/1994 | Stoddard et al. | 108/165 |

FOREIGN PATENT DOCUMENTS

| | | | |
|---|---|---|---|
| 4948 | of 1905 | United Kingdom | 108/162 |

*Primary Examiner*—Jose V. Chen

[57] ABSTRACT

A collapsible portable support for providing an elevated working surface, and having right and left hand end walls, a pair of platform panels hinged to respective end walls at their outer ends, and hinged together at their inner ends, so as to swing between upwardly folded positions and generally horizontally extended positions, a first pair of right and left hand panel supports and a second pair of right and left hand panel supports, the panel supports being in interdigital relation with one another and hinges connecting respective first right and left panel supports on respective second right and left hand panel supports for folding towards and away from one another, and hinges connecting respective panel supports to respective end walls.

7 Claims, 9 Drawing Sheets

PORTABLE WORK BENCH

FIELD OF THE INVENTION

The invention relates to a portable work bench which is adapted to a variety of different uses, and in particular, to such a portable work bench which is fabricated out of moulded thermoplastic materials.

BACKGROUND OF THE INVENTION

Portable work benches of various kinds are known, which are intended to fulfill some or more of similar functions. The simplest such bench is the typical saw horse. This is a relatively elementary form of such a bench. More complex such benches are available which can perform a variety of functions. The best known such bench is the "Workmate" (trademark) bench, manufactured by Black & Decker Corporation. The extensive world wide sales of this popular accessory establish beyond any doubt the extent of the market for this type of equipment. There are however certain drawbacks and disadvantages inherent in even this popular accessory. It is manufactured of a number of sheet metal parts, which are relatively expensive to manufacture, and assemble. The parts must be fastened together with great care and security in order to provide stable legs for the bench. The bench incorporates a complex folding mechanism whereby both the top and the legs can be folded flat for carrying, and this further complicates the design and construction.

As a result, the retail price to the consumer can represent a significant purchase item.

It is also fair to say that while this type of accessory provides a convenient and effective support for carrying out various types of work on a work piece using hand tools, there are some functions for which it is not completely suitable. One particular function is that of providing a stable work platform on which a workman can stand, above the floor, while performing tasks which are beyond his normal reach, such as in painting, papering, covering in a ceiling, and like, and doing electrical installations. In most cases, workmen will use some form of step ladder for this type of work. However a stepladder is not always the most convenient work platform since it must constantly be moved from place to place. This is especially true for example in wall papering or the like.

There are also many occasions when it is desirable to set up a large flat table area for cutting a work piece. Typically workmen are required to cut large sheets of plywood wallboard and drywall, at a work place. In many cases it is necessary for the workmen to set up a special table for the purpose. Usually such table incorporates a large platform of thick plywood which must then simply be supported on legs. Typically two pairs of sawhorse legs are used each supporting a two by four piece of lumber, forming four-legged trestles. The piece of plywood forming the table surface is simply balanced on top of this structure.

This may therefore mean that a workman at a work site doing a variety of different jobs may be required to bring sawhorses, and pieces of two by four lumber, a table platform, a portable work bench for other functions, and a step ladder. Clearly, it will be desirable if a number of these different functions could be combined in a convenient work bench accessory which would function at least both as a work bench and as a stable standing platform, and which with minor modifications could also function as the trestles for supporting a larger temporary work surface of the type described.

One proposal meeting many of these objectives is shown in U.S. Pat. No. 4,763,757, issued 08/19/1988, titled Saw Horse, Inventor: Kirk S. Cheney.

The work support disclosed in that Patent satisfies many of the objectives described. When manufactured for example of thermo-plastic material, it is relatively economical to manufacture, and consequently, in mass production, can be retailed at a lower price than other types of work bench accessory manufactured in sheet metal.

However, the particular work support disclosed in the aforesaid U.S. patent, while being effective for many purposes, was not entirely suited for use as a platform upon which a workman could stand at an elevation above the floor. Such a working platform may require a workman to move about from side to side or away from or towards a wall for example, or underneath the ceiling. In some of these cases, the platform disclosed in that patent might have slight tendency to move or tilt.

It is, therefore, desirable to provide an improved form of work bench which can be used as a work platform to support a workman at an elevation, and which provides a stable sure footing for the workman.

BRIEF SUMMARY OF THE INVENTION

With a view to answering at least some of these complex requirements the invention comprises a collapsible portable support apparatus of the type for supporting a work piece, or for providing an elevated working platform, and comprising, right and left hand end wall members defining floor engaging feet, a pair of platform panels hingedly connected to respective end members, at their outer ends, and hingedly connected together, at their inner ends, and adapted to swing between upwardly folded positions and generally horizontally extended positions, first and second right and left hand panel support members being associated in interdigital relation with one another, hinge means connected respective first right and left panel support members for folding action towards and away from one another, hinge means connected said second right and left hand panel support members for folding action towards and away from one another, and, hinge means connecting respective right hand panel support members to one said end member, and connecting extensions of respective left hand panel support members to the other said end member.

Another feature of the invention provides such a collapsible portable support apparatus and wherein said end wall members are adapted to adopt a nonvertical position, with said feet of respective end wall members spaced apart a greater distance than the remainder of said end wall members, when said panel support members are in their outwardly folded position, away from one another.

Further features of the invention include notches formed in the upward extensions of the side panels, adapted to receive a piece of lumber.

Further features include hinges formed by interfitting hook portions and abutments which make interdigital engagement, and are held together by hinge pins. Notches and extensions are formed in alternate fashion in the panel support members so as to interfit with one another. Steps are formed in one or both of the end panels, and in the panel support members.

Further optional features would include an upper end panel extension and a releasable attachment means.

The invention is also applicable with modifications to providing table panels and supports for table panels, with the supports being engaged beneath the table panels on rollers.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
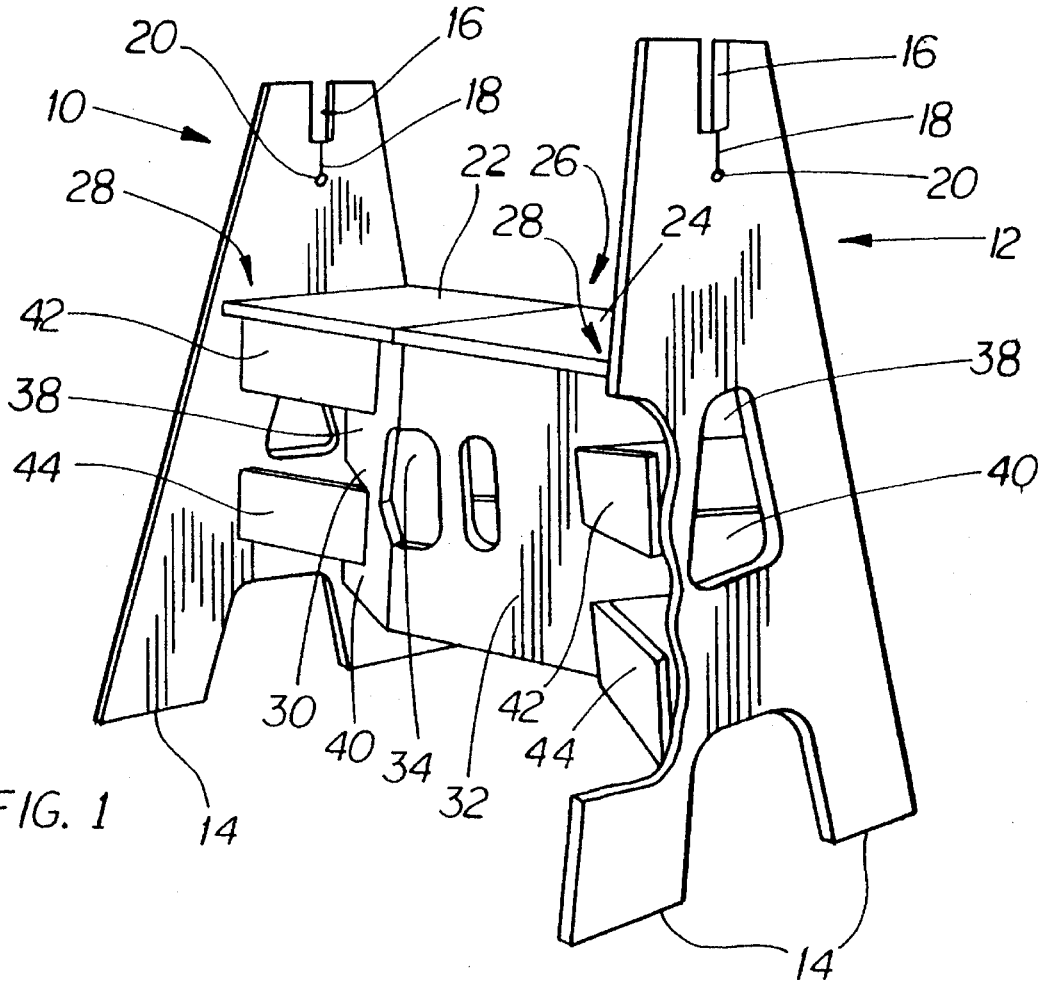
FIG. 1 is a front perspective illustration of an embodiment of work bench which is illustrative of the invention.

Referring first of all to FIG. 1, it will be seen that the work bench which is described here by way of example for the purpose of illustrating the invention, comprises a pair of right and left hand end wall panel members 10 and 12, which at their lower ends define feet 14. They are of generally truncated triangular shape in elevation. At their upper ends they define, in this particular embodiment, generally vertically oriented notches 16. The notches 16 are open at their upper ends. At their lower ends, they communicate with slots 18. The lower ends of slots 18 terminate in generally circular shaped enlarged openings 20.

A pair of right and left hand platform panels 22 and 24 extend between the end panel members 10 and 12. The panels 22 and 24 are hinged at a median point by hinge means 26 to be described later, and are also hinged at either end, at 28—28 to the end members 10 and 12.

The panels can be swung upwardly into a closed or folded position and swung downwardly into an out-folded or extended position.

In order to support the two panels in their extended position and to hold the two end members in their angulated inwardly inclined spaced-apart position, when extended in use, there is provided a first pair of right and left hand panel supports 30 and 32, and a second pair of right and left hand panel support 34 and 36. The first pair of right and left hand panel supports 30 and 32 are provided at notches **30*a* and 32*a* with respective upper and lower extension portions 38 and 40** of reduced width, spaced apart from one another.

The second pair of right and left hand panel supports 34–36 are also provided at notches **34*a* and 36*a* with upper and lower extensions 42 and 44** of reduced width, spaced apart from one another.

Each of the first and second pairs of right and left hand panel supports are provided with generally three sided rectangular openings 46, 48, defined between respective extensions.

The first and second right and left hand panel supports, are constructed with median upper and lower hinges 50 and 52.

The extension portions are provided with upper hinges 54 and lower hinges 56, by means of which they are swingably connected to their respective end panels.

Figure 2:
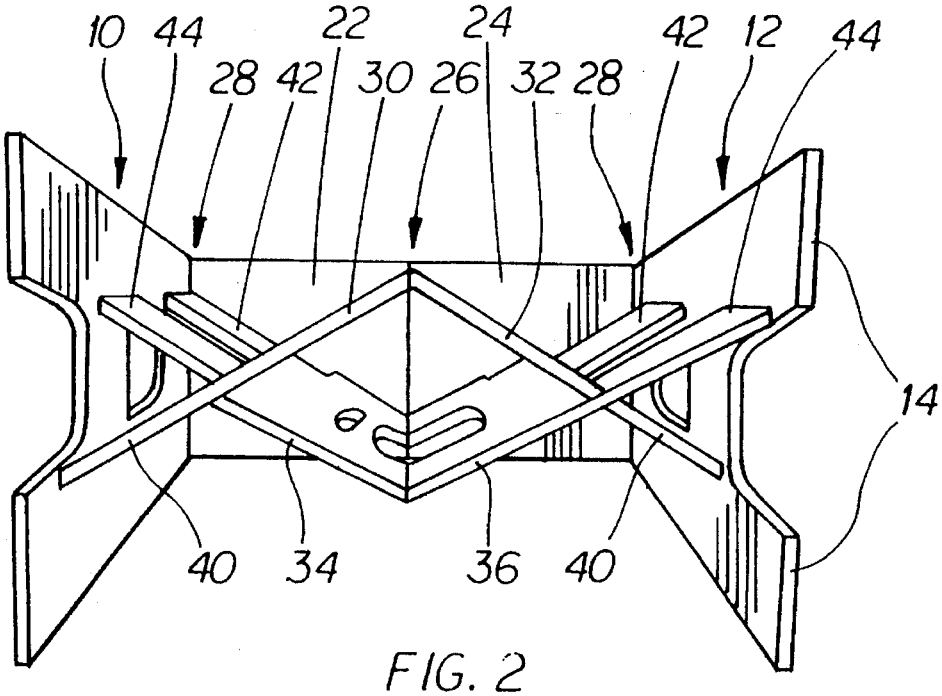
FIG. 2 is a bottom perspective illustration of the embodiment of work bench shown in FIG. 1.
Figure 3:
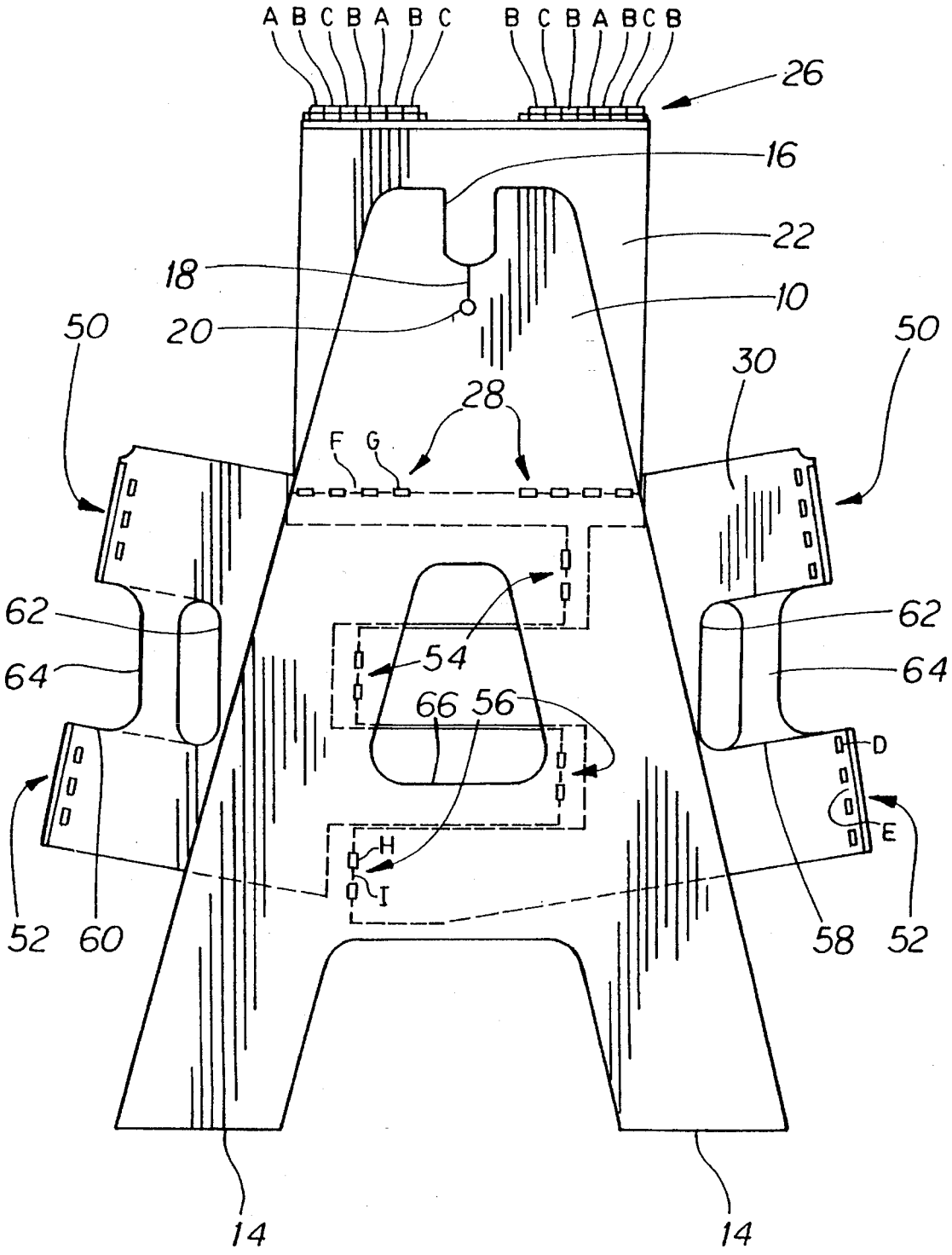
FIG. 3 is an end elevation of the work bench of FIG. 1, shown in its collapsed or in-folded position with portions shown in phantom lines.
Figure 4:
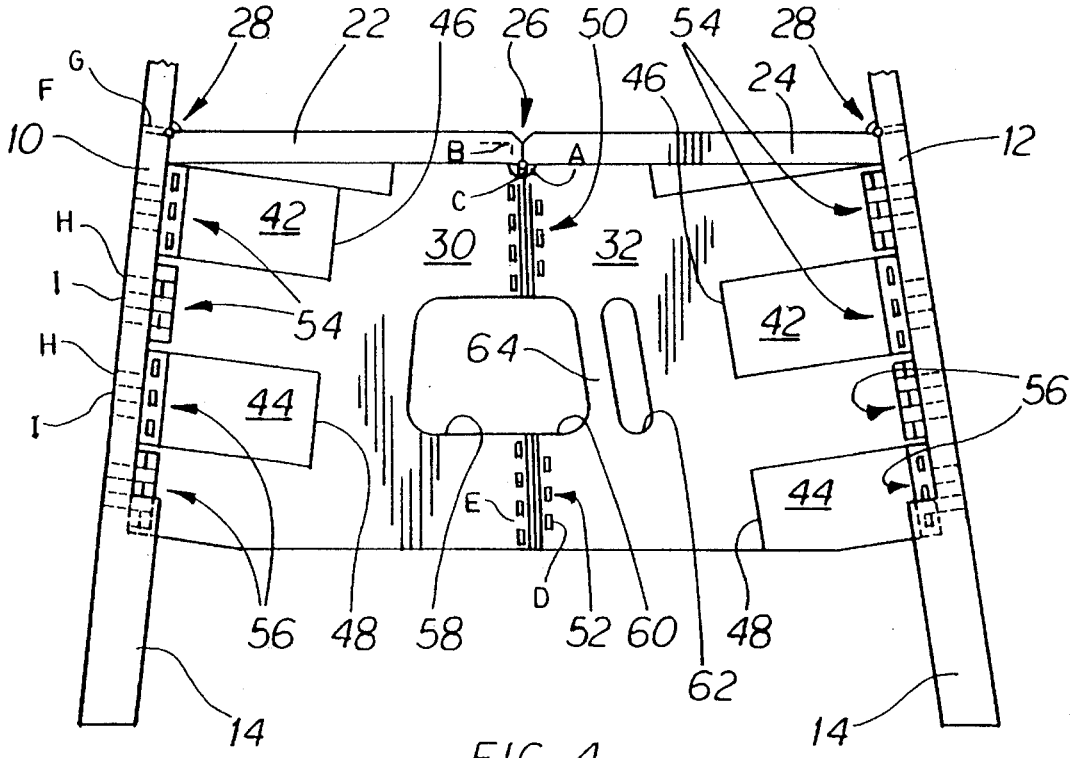
FIG. 4 is a front elevation of the work bench of FIG. 1, shown in its out-folded or extended position.
Figure 5:
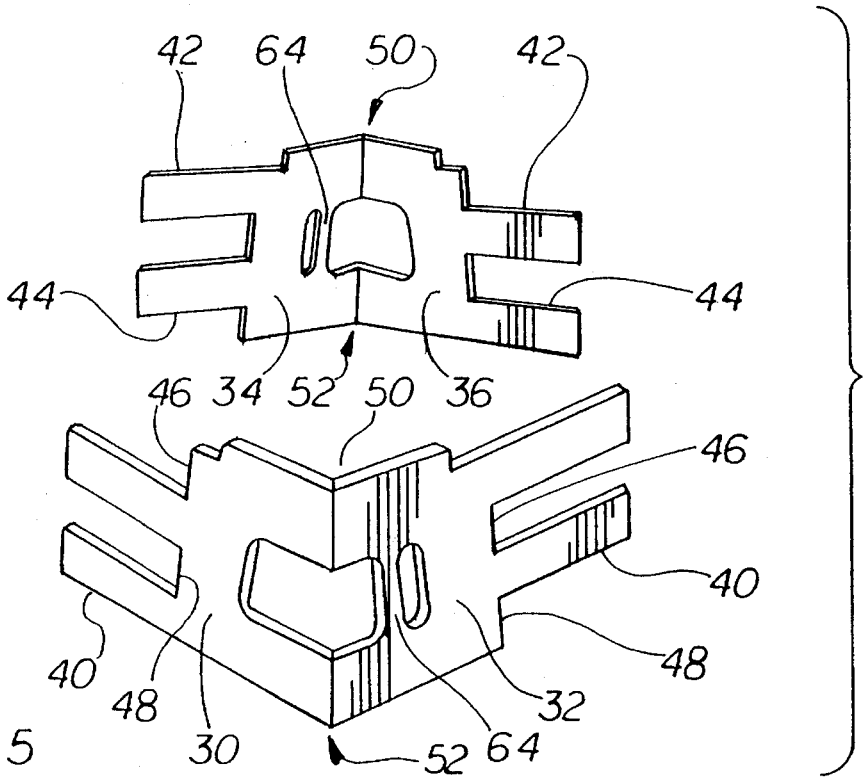
FIG. 5 is a perspective illustration of the support members of the work bench of FIG. 1, in isolation, shown in front perspective.
Figure 6:
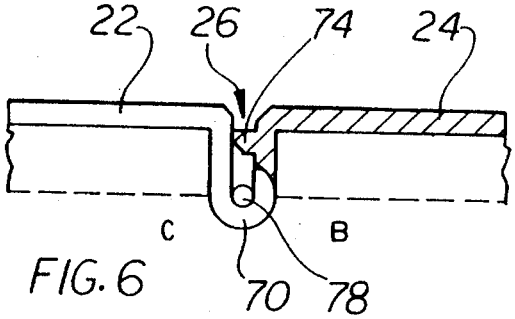
FIG. 6 is a enlarged section of the hinges at the points C, B, or FIG. 4.
Figure 7:
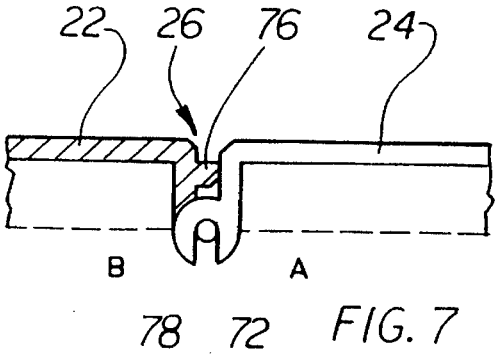
FIG. 7 is a section of the hinges at the points B,A, of FIG. 4.
Figure 8:
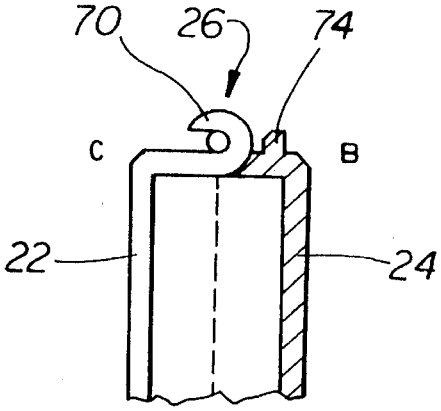
FIG. 8 is a section of the hinges at the point C,B, of FIG. 3.
Figure 9:
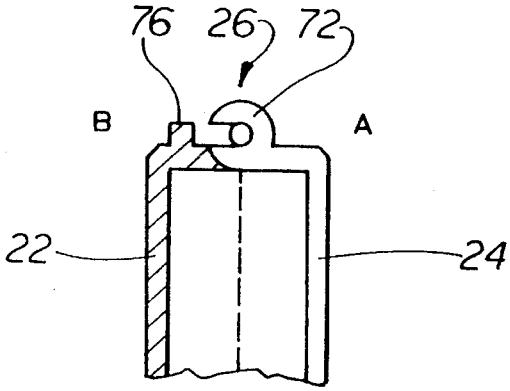
FIG. 9 is a section of the hinges at the points B,A of FIG. 3.

By means of the openings 46 and 48, which are of a size to correspond to the widths of the extensions, the extensions on respective first and second pairs of panel supports may be arranged in interdigital relation, as shown in FIGS. 1 and 2, with the extensions of one pair of panel supports fitting through the openings of the other pair of panel supports, and vice versa.

The axes of the hinges 54, 56 are such that when the end panels are in their extended position, they are further apart at their lower ends and are inclined together towards their upper ends.

In order to provide a convenient step, for use by a workman who wishes to step up on to the platform, openings 58 and 60 are formed in the respective right and left hand support panels. These openings thus define steps of median height on either side of the device, which are available for use for stepping up on to the platform.

In addition, further openings 62 are formed so as to provide a handle 64 by means of which the device may readily be carried when folded.

Additional steps are formed in the end members 10 and 12, by means of generally triangular shaped openings 66.

The various hinge means will now be described in more detail.

Referring to FIGS. 6, 7, 8 and 9, the median hinge means 26, between the platform members 22 and 24, will be seen to comprise a plurality of hook portions 70, and 72, formed on respective members 22 and 24, in an alternating fashion. Between the hook members 70 and 72, there are formed abutment members 74 and 76.

Cylindrical plastic or metallic hinge pins 78 are slid between respective hook members 70 and 72, thereby forming a hinge which may be opened and closed in the manner shown in FIGS. 6, 7, 8, and 9.

Figure 10:
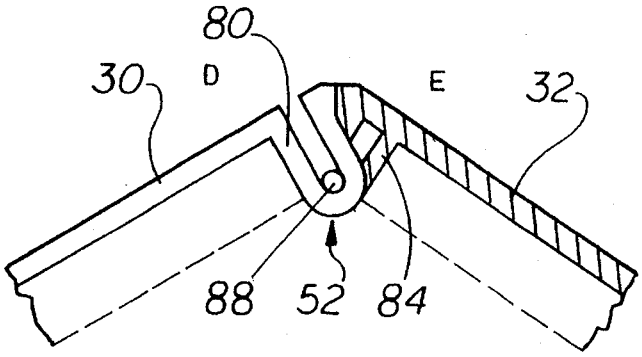
FIG. 10 is a section of the hinges at the points D,E, of FIG. 4.
Figure 12:
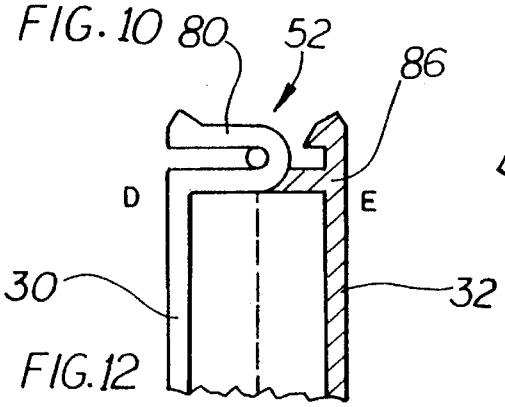
FIG. 12 is a section of the hinges at the point D, E of FIG. 3.
Figure 11:
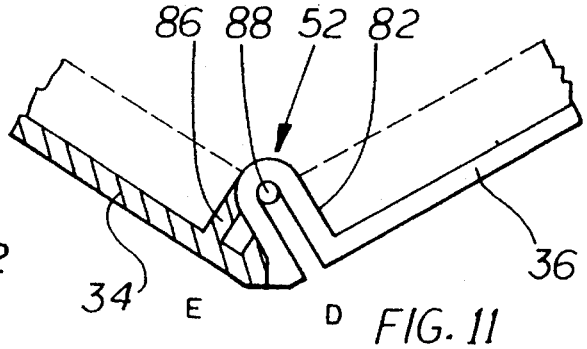
FIG. 11 is a section of the hinges at the points E,D, of FIG. 4.
Figure 13:
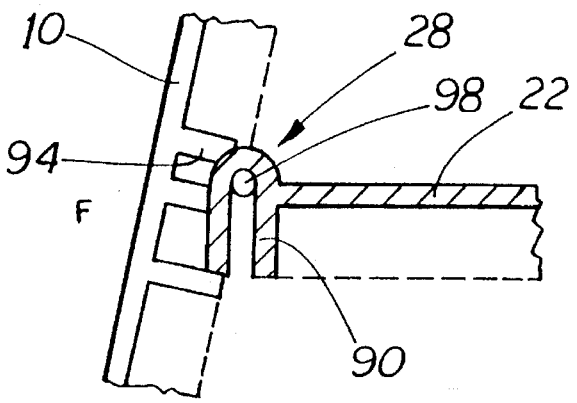
FIG. 13 is a section of the hinges at the point F of FIG. 4.
Figure 14:
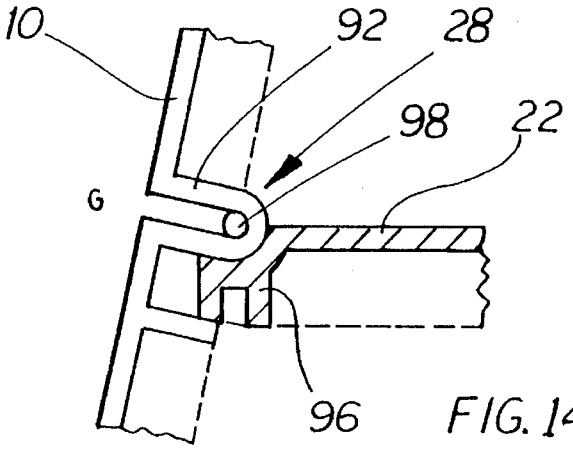
FIG. 14 is a section of the hinges at the point G of FIG. 4.
Figure 15:
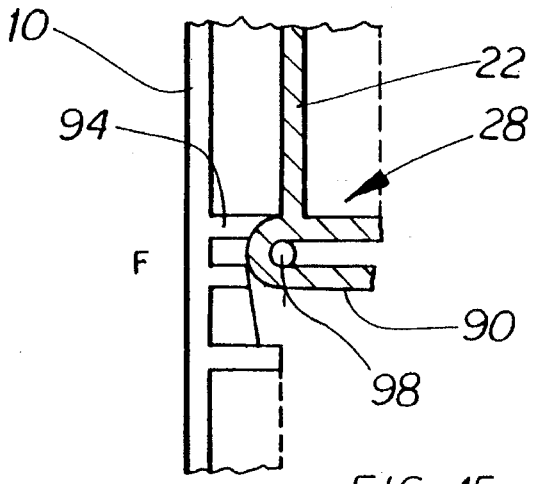
FIG. 15 is a section of the hinges at the point F of FIG. 3.
Figure 16:
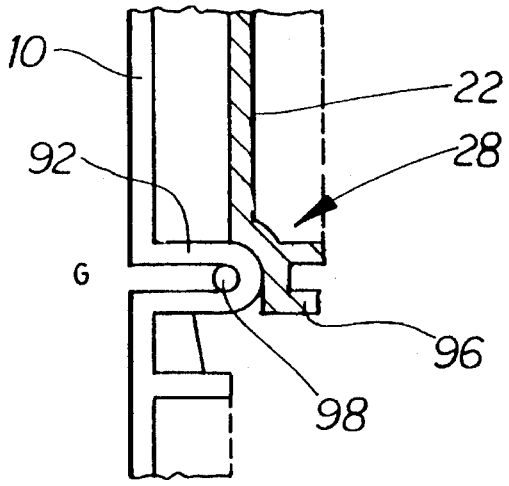
FIG. 16 is a section of the hinges at the point G of FIG. 3.
Figure 17:
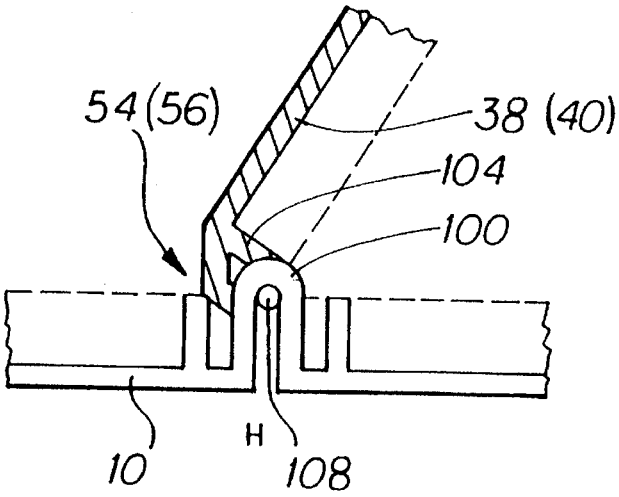
FIG. 17 is a section of the hinges at the point H of FIG. 4.
Figure 18:
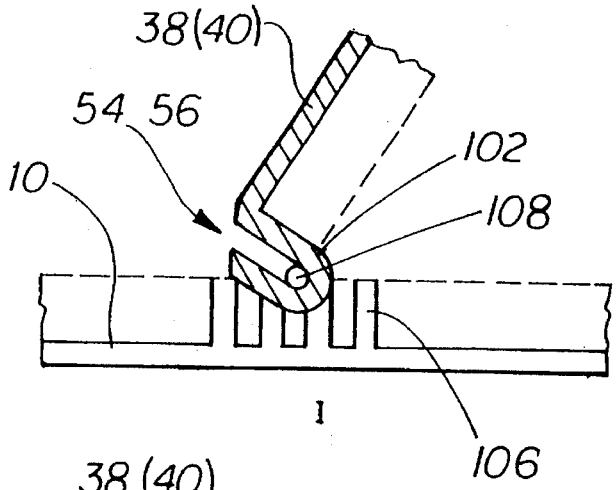
FIG. 18 is a section of the hinges at the point I of FIG. 4.
Figure 19:
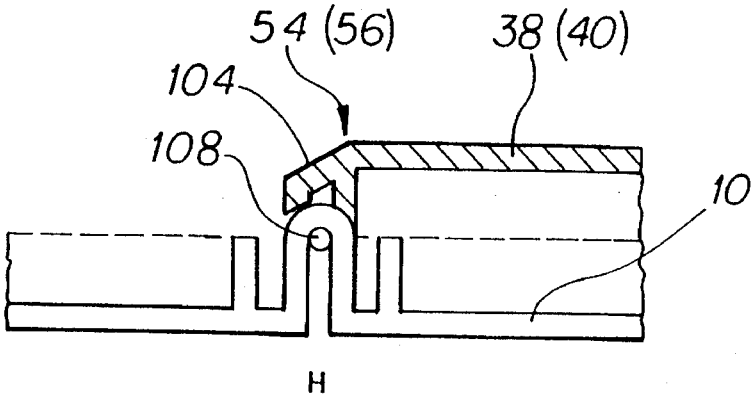
FIG. 19 is a section of the hinges at the point H of FIG. 3.
Figure 20:
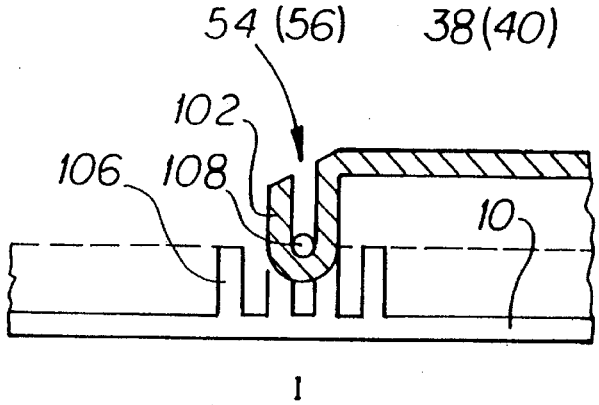
FIG. 20 is a section of the hinges at the point I of FIG. 3.

The hinge means 50 and 52, joining the median portions of the panel support 30, 32, 34, and 36 respectively are shown in FIGS. 10, 11 and 12. They are of similar construction, and comprises alternating hook portions 80, 82, and abutment portions 84–86.

The hinge means 28, joining the ends of the platform panels 22, 24, to the end members 10–12, are shown in FIGS. 13, 14, 15, and 16.

Only the hinge means at the end member 10 are illustrated, since the hinge means at the end member 12 are identical.

The hinge means 28 will be seen to comprise alternate hook portions 90, on platform panels 22 (24) and hook portions 92 formed on end members 10 (12). The spaces between the alternating hook portions 92, contain abutments 94, and the spaces between the alternating hook portions 90 contain abutments 96.

Continuous hinge pins 98 of plastic or metal pass through the hook portions 90 and 92 alternately, thereby forming a hinge.

The hinge means 54, 56, joining the extension portions to the end panels, are shown in FIGS. 17, 18, 19 and 20.

Each of the hinge means 54–56 will be seen to comprise two sets of alternating hook portions 100, formed on end wall members 10, 12 and hook portions 102 formed on respective extensions 38, 40, 42 and 44.

Between the alternating hook portions 100 and 102 respectively, there are formed abutments 104, on extensions 38, 40 and abutments 106 on end members 10, 12.

It will be appreciated the hook portions 100 and abutments 106 are formed on end panels 10–12 as two spaced apart columns, on opposite sides of openings 66. This causes the extensions of the panel supports to cross over in interdigital arrangement as shown.

Two continuous hinge pins 108 pass through alternating hook portions 100 and 102 and thereby hold them together to form hinges.

Figure 21:
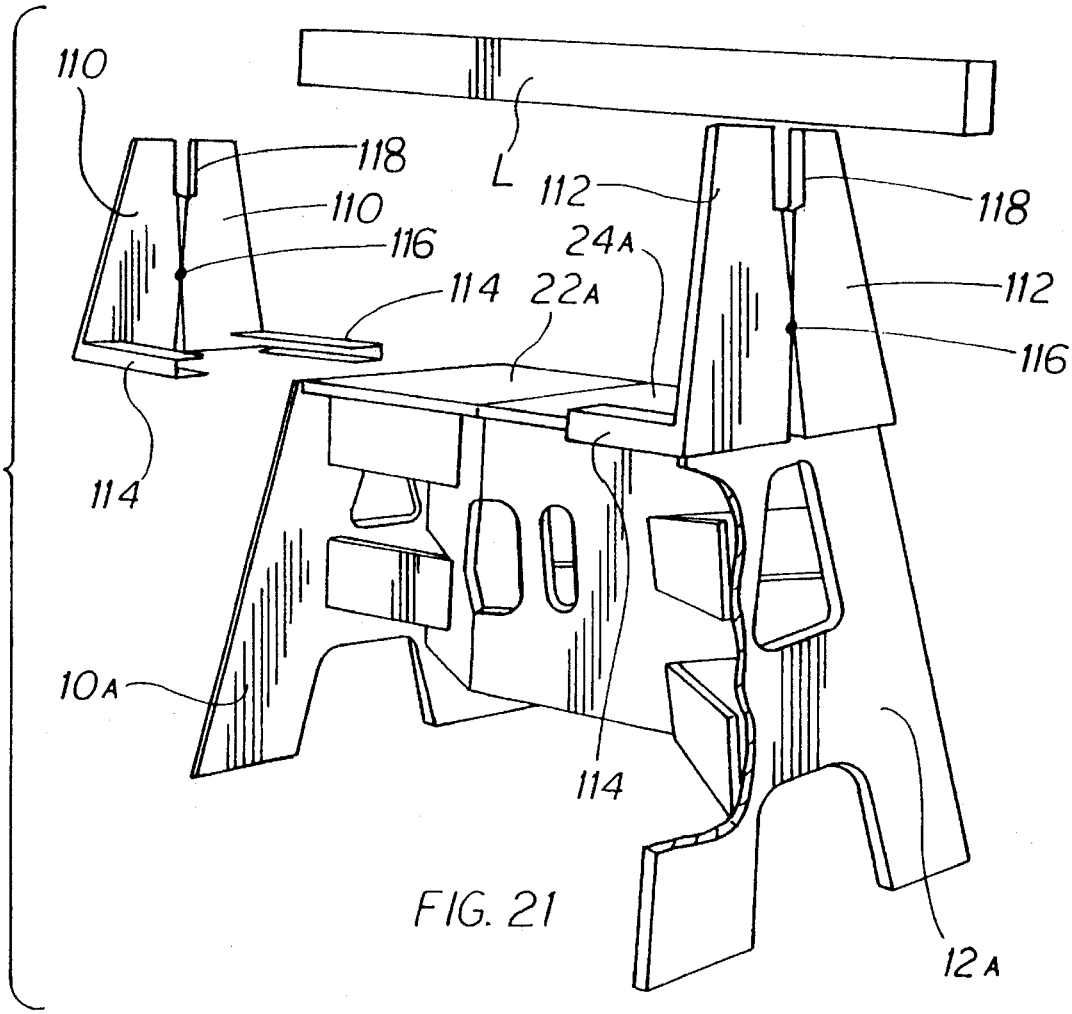
FIG. 21 is a perspective illustration of an alternate embodiment of work bench.
Figure 22:
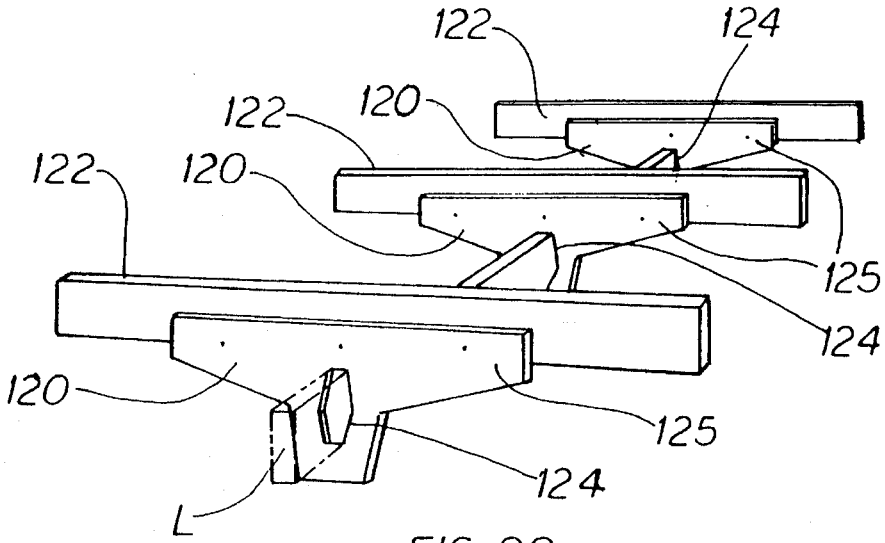
FIG. 22 is a perspective of an accessory, for use with the work bench.
Figure 23:
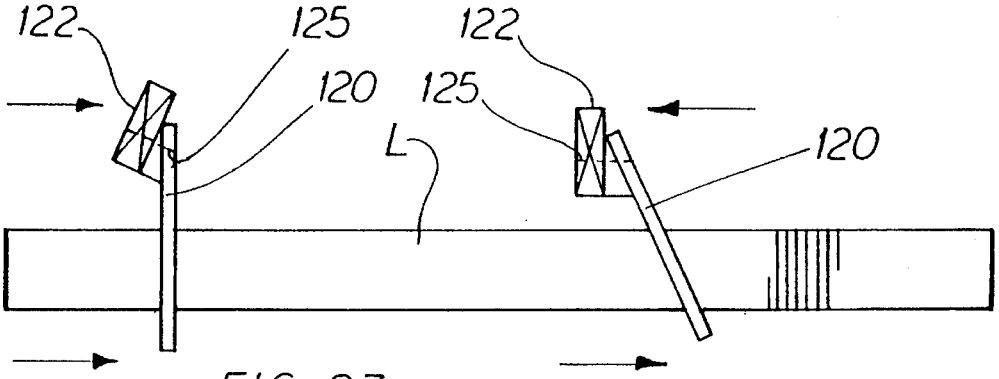
FIG. 23 is a schematic side elevation of the accessory of FIG. 22, shown in two different positions.

A further embodiment of the invention is shown in FIGS. 21, 22, and 23.

In this embodiment of the invention, the work bench makes use of end members 10*a* and 12*a* which are essentially similar to end members 10 and 12 of FIG. 1, and platform panels 22*a* and 24*a* which are also essentially similar to the embodiment of FIG. 1.

However, it will be noted that the end members 10*a* and 12*a* do not have the upper extension portion with the U-shaped notches, and that the platform panels 22*a*, and 24*a* are hinged to the upper edges of the end members 10*a*, 12*a*.

Similar panel supports and extensions are provided in this embodiment as in the case of the embodiment of FIG. 1, so that it may be extended and opened up, or folded flat as described in connected with the embodiment of FIG. 1. This embodiment thus provides a form of portable bench, with the platform panels at bench height. It can also be used as a very stable step stool around the home.

In this embodiment, additional accessories may be provided. These accessories comprise pairs of end extension portions 110–112 which are provided with generally transversely extending channel portions 114—114. The channel portions are dimensioned so as to make a snug friction fit on the side edges of the platform panels 22*a*, 24*a*. The end extensions are pivoted at their centres at 116 so that they may swing relative to one another. This enables the channels 114 to be fitted onto the edges of the platform panels 22*a*–24*a*. The end extensions 110–112 are provided at their upper ends with U-shaped notches 118, for receiving a piece of lumber such as a two-by-four, thus forcing channel portions 114—114 to clamp onto platform members 22*a*–24*a*.

Clearly, if two work benches are provided and erected in spaced apart parallel relation, and are provided with pieces of lumber in the manner described, they will support the opposite ends of a table platform (not shown) to provide a temporary level work surface at a work site.

In some cases, however, it may be desirable to support such a temporary work surface on a single such work bench. In this case, additional accessories, such as are shown in FIGS. 22 and 23 may be provided. These further accessories comprise a plurality of separate mounting panels 120, each of which along its upper edge may be provided with a support bar 122, attached to panel 120 with wood screws 125.

Each of the mounting panels is formed with a generally six-sided or hexagonal openings, the precise shape being irrelevant. The openings define wider median portions 124, and narrower ends which lock on lumber L.

In this way, several of these mounting panels 120 may be slid onto a single piece of lumber L. The piece of lumber may be support on the two end extension of the work bench. The mounting panels may then be slid along the piece of lumber to appropriate locations. They may be then swung into an angle as shown (FIG. 23) to lock into position. A flat table panel (not shown) may thus be supported.

A further embodiment of the invention is shown in FIGS. 24, 25, 26, 27, and 28. In this embodiment the invention is illustrated in the form of a portable table 130. Table 130 comprises end legs 132–134 supporting table panels 136–138 at a suitable table height. Legs 132, 134 are, in this embodiment of generally rectangular U-shape, in elevation. At their upper ends rollers 140 are rotatably attached. Panels 136–138 have channel-shaped roller tracks 142 arranged in parallel spaced apart locations to receive rollers 140, and are hinged together centrally at 143. Pairs of panel support arms 144—144 and 146—146 extend between legs 132, 134. Panel support arms 144 are hinged together at 148. Panel support arms 146 are hinged together at 150. Arms 144 are hingedly attached to one side of legs 132 and 134 at 151, and arms 146 are hingedly attached at 152 to the other sides of legs 132, 134.

Arms 144 and 146 are formed with a generally L-shape in elevation. In this way arms 144 and 146 may be arranged in interdigital engagement, as in the embodiment of FIG. 1.

Figure 24:
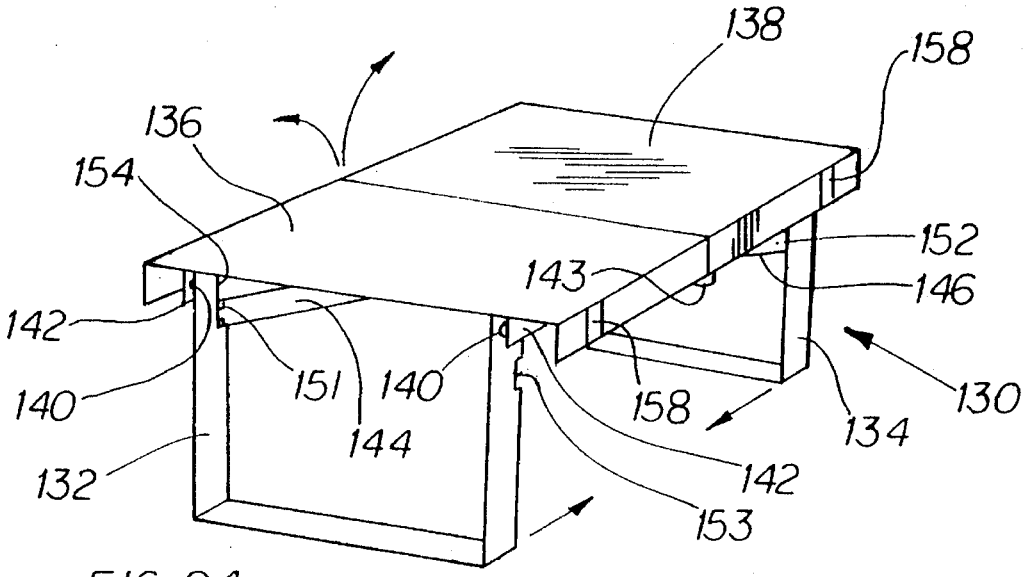
FIG. 24 is a perspective of a further alternate embodiment.
Figure 25:
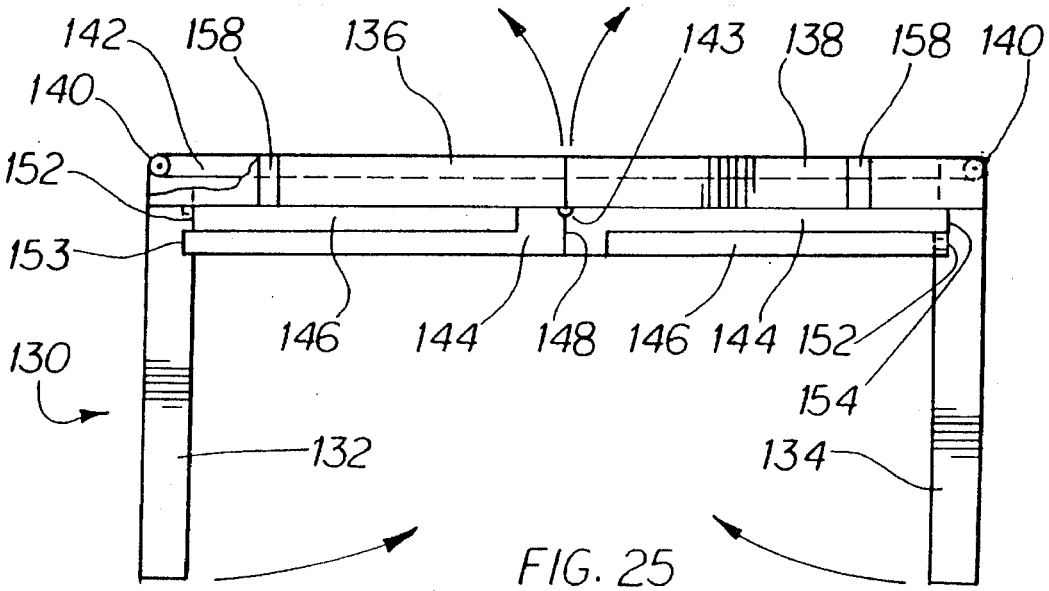
FIG. 25 is a side elevation, partially cut away of FIG. 24.
Figure 26:
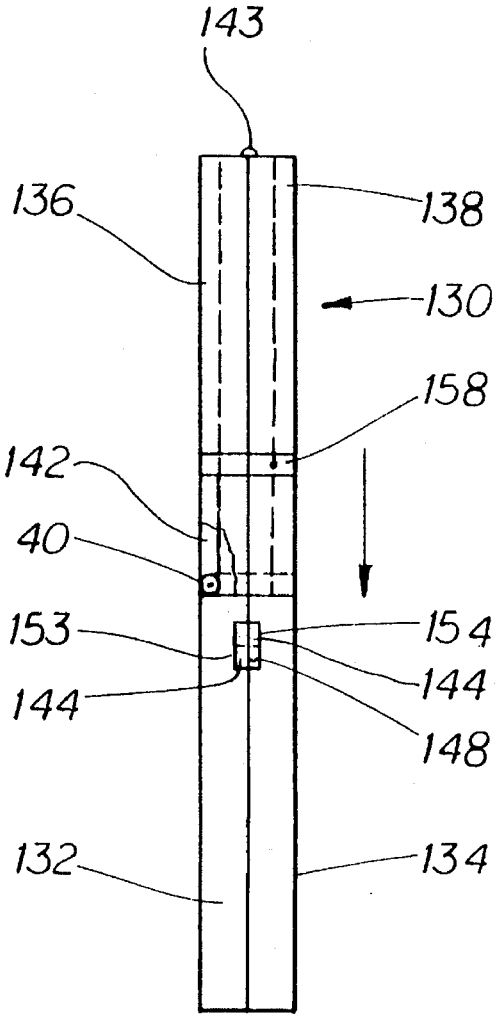
FIG. 26 is a side elevation of FIG. 24 in a partly folded position.

In operation the table 130 may be used in its extended position (FIG. 24). For transportation or storage it may be collapsed by folding panels 136–138 upwardly (FIG. 26). This will draw legs 132–134 together, and cause folding of arms 144 and 146 together, which come to rest within lower notch 153 and upper notch 154 of legs 132, 134. Panels 136–138 rotate on rollers 140 in tracks 42 to reach the vertical folded position.

Figure 27:
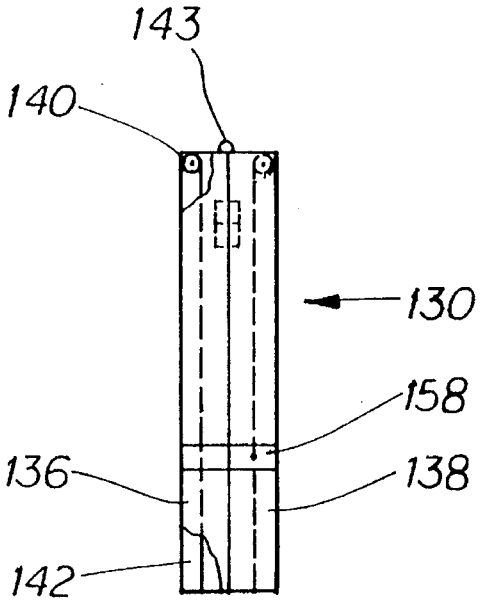
FIG. 27 is a side elevation of FIG. 26 in a fully folded position.
Figure 28:
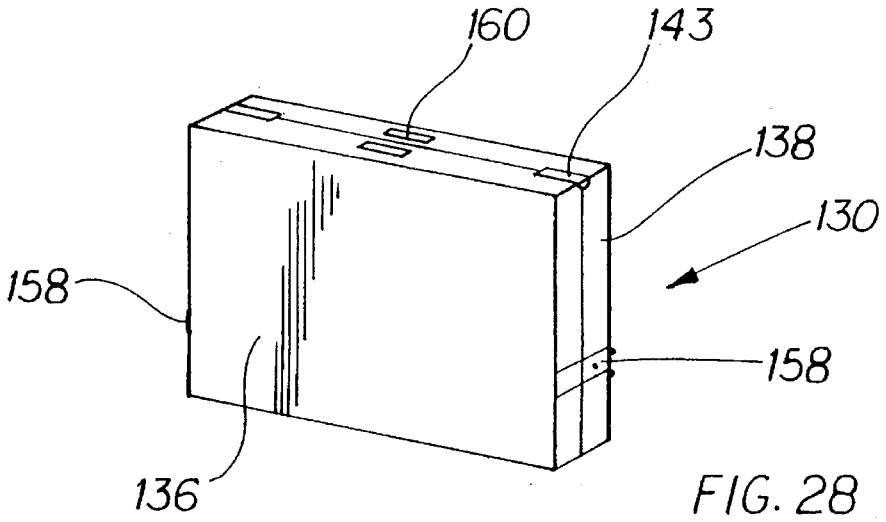
FIG. 28 is a perspective of FIG. 27.

Panels 136–138 may then be slid down over legs 132–134, with rollers 140 sliding along trackways 142, so that the final collapsed position is as shown in FIGS. 27 and 28. Panels 136–138 may be fastened together, e.g. by straps 158, and carried by handles 160.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A collapsible portable support apparatus of the type for supporting a work piece, or for providing an elevated working platform, and comprising;

right and left hand end members defining floor engaging means;

a pair of platform panel members having outer and inner ends and being hingedly connected to respective end members, at their outer ends, and hingedly connected together, at their inner ends, and adapted to swing between upwardly folded positions and generally horizontally extended work positions;

a first pair of right and left hand panel support members defining intermediate ends and outer ends and defining respective extensions, and notches between said extensions;

a second pair of right and left hand panel support members defining intermediate ends and outer ends and defining respective extensions, and notches between said extensions;

said first and second right and left hand panel support members being associated with respective extensions in interdigital relation with one another fitting within respective notches;

first intermediate hinge means connecting respective extensions of respective first right and left panel support members for folding action towards and away from one another, and second intermediate hinge means connecting respective extensions of said second right and left hand panel support members for folding action towards and away from one another, and, end hinge means connecting respective right hand panel support members to said right hand end member, and further end hinge means connecting respective left hand panel support members to said left hand end member.

2. A collapsible portable support apparatus as claimed in claim 1 and wherein said end members are adapted to adopt a non-vertical position, with said floor engaging means of respective end members being spaced apart a predetermined distance and being angled towards one another, when said platform panel members are in their horizontally extended work position.

3. A collapsible portable support apparatus as claimed in claim 1 wherein said hinge means for at least some of said end members and platform panel members and panel support members comprise hinge hook portions, on one of said members, spaced apart from one another by predetermined spacings, and hinge abutment portions on another of said members, arranged spaced apart, with said hook portions and said abutment portions being adapted to interfit with one another, and hinge pin means adapted to fit between them, whereby to form said hinge means.

4. A collapsible portable support apparatus as claimed in claim 1 and wherein each of said panel support members define respective said upper and lower extension spaced apart from one another by said notches, and wherein said upper extensions are of a predetermined length, and wherein said lower extensions are of a length greater than said predetermined length.

5. A collapsible portable support apparatus as claimed in claim 4 and wherein said platform panel members define a predetermined width when extended in their horizontal work position, and wherein said right and left hand panel support members, adjacent said intermediate and further intermediate hinge means, are spaced apart from one another towards opposite sides of said platform panel members.

6. A collapsible portable support apparatus as claimed in claim 1 including step opening means formed in at least one of said panel support members.

7. A collapsible portable support apparatus as claimed in claim 6 including further step opening means in at least one of said end members.

* * * * *